United States Patent [19]
Van Benthuysen et al.
[11] 4,318,221
[45] Mar. 9, 1982

[54] PROCESS FOR PRODUCING AN ON-OFF PUSH SWITCH AND RESULTING ARTICLE

[75] Inventors: John D. Van Benthuysen; Carlton M. Osburn, both of Elkhart, Ind.

[73] Assignee: CTS Corporation, Elkhart, Ind.

[21] Appl. No.: 261,588

[22] Filed: May 7, 1981

Related U.S. Application Data

[62] Division of Ser. No. 119,643, Feb. 8, 1980, Pat. No. 4,293,751.

[51] Int. Cl.[3] ..... H01H 11/00
[52] U.S. Cl. ..... 29/622
[58] Field of Search ..... 29/622; 200/64, 153 J, 200/156; 74/88

[56] References Cited

U.S. PATENT DOCUMENTS

| | | | |
|---|---|---|---|
| 2,422,087 | 6/1947 | Hansen | 200/243 |
| 3,167,620 | 1/1965 | Keyser et al. | 200/155 R |
| 3,204,067 | 8/1965 | Brown | 200/156 |
| 3,226,991 | 1/1966 | Harsock | 200/156 |
| 3,329,790 | 7/1967 | Schink | 29/622 X |
| 3,694,603 | 9/1972 | Congelliere | 200/153 J |

FOREIGN PATENT DOCUMENTS

| | | | |
|---|---|---|---|
| 387216 | 12/1926 | Fed. Rep. of Germany | 200/64 |
| 1437609 | 3/1966 | France | 200/156 |
| 1235268 | 7/1969 | United Kingdom | 200/156 |

*Primary Examiner*—Leon Gilden
*Attorney, Agent, or Firm*—John A. Young; Larry J. Palguta

[57] ABSTRACT

A method for producing a rotary on-off switch in which a contactor plate is formed from sheet metal stock, integrally molded with a switch housing and thereafter blanked from the sheet metal stock. The switch housing has an integral set of circumferentially spaced abutments at regular intervals in an internal socket opening of the housing. A first switch operating member having a stem and a plurality of crowned teeth is internally mounted in the housing. A second switch operating member also has a set of crowned teeth disposed complementary to those on the first switch operating member, and also is disposed in the housing so that upon coaxial movement of the two operating members the second switch operating member will be caused to rotate abruptly after the second switch operating member has been displaced axially sufficiently to disengage the second switch operating member from the abutments in the housing. This described coaxial movement occurs manually, and a spring effects restoration of the two operating members to their original positions to the accompaniment of additional angular movement of the second switch operating member. An annular drive arm is coupled to the second switch operating member for angular movement therewith, and has resilient upwardly extending contactor paddles biased against and slidably contacting the contactor plate.

3 Claims, 15 Drawing Figures

PROCESS FOR PRODUCING AN ON-OFF PUSH SWITCH AND RESULTING ARTICLE

This is a division of application Ser. No. 119,643, filed Feb 8, 1980 and issued on Oct. 6, 1981 as U.S. Pat. No. 4,293,751.

BACKGROUND OF THE INVENTION

In radio controls for automobiles there is needed a control device which will turn the radio off with a simple push connection and then with a second pushing action turn the radio on again. This successive on-off by successive pushes is known in the art as a "push-push" switch actuation. The present invention is, of course, not limited to the operation of a radio in vehicles, but is especially useful in that type of device since the volume can be set so that immediately upon turning off and then turning on the radio again the same volume level will be maintained. There are other useful applications such as multipole, stepping, and selector switching all of which are contemplated for a so called push-push operating switch and the reference to a radio is only one convenient application.

In prior devices and particularly U.S. Pat. No. 3,204,067 "PUSH ROTARY SWITCH CONSTRUCTION WITH LOST MOTION CONTACT COUPLING" issued Aug. 31, 1965 to W. L. Brown and assigned to Boyne Products, Inc., there is illustrated a rotary switch of the push-push type in which successive pushing actions will successively produce on-off switch operation. However the switch action must be abrupt causing a crisp and definite engagement and disengagement of the switch members. If there is a lack of precision in the making and breaking of contacts in the switch operation, a slow disengagement time will produce excessive heating and wear of the switch members in addition to arcing and the like. In previously used push-push switches, the switch operation lacked a clean, quick on-off operation with the result that the lag occurring during the making and breaking of contacts and at other phases of actuation made the switch deficient in its definiteness of position and response that are so essential to applications such as radio on-off control.

Another impediment to the obtainment of a practical on-off, push-push switch in the prior art is the excessive number of components which greatly complicate the matter of assembly and construction of the switch. Obviously, a great number of components, all of which must be separately manufactured and assembled, adds considerably to the cost of producing the switch and maintaining it in good working order.

Another complication of the multiplication of components in the switch is the stack-up of tolerances which complicates the matter of proper assembly because each of the components varies in dimension and finish, and consequently the number of rejects and adjustments necessary to assemble such a multi-component system is directly proportional to the number of parts which are involved in its fabrication. In a push-push type switch, the central concept is that in one increment of operation switch actuation will occur, and then a second increment of operation will reset the switch for a successive operation. An unfortunate occurrence in prior art devices is an indefiniteness in the phase of plunger movement at which the switch actuation would occur, and the user would frequently, after having depressed the switch sufficiently to effect the on or off operation, have moved the plunger insufficiently so that upon retraction of movement the device is improperly reset to the same initial on-off position. This contributes to an unpopularity in the prior art devices of a push-push type switch. Accordingly, the accumulative drawbacks of the type of switch described has generally lead to a failing to adopt the particular switch in spite of obvious advantages inherent in that type of construction, not the least of which is that in radios a push-push type actuation rendered independently of volume control will ensure that once the radio is turned off and then reactuated, it will resume the station at the same volume as occurred in the prior on position of the radio.

SUMMARY OF THE INVENTION

It is a principal object of the present invention to provide a rotary switch which requires less effort to effect its operation and does so more positively with a fewer number of components.

Another object of the present invention is to provide a rotary switch which has more a positive placement of the components of the switch thereby insuring greater precision in operation, and a more positive abrupt off operation.

An important object of the present invention is that the extent of linear movement of the switch produce a switch operation within a very narrow range of rectilinear movement near the terminal phase of rectilinear movement of the plunger so that the switch operation is made functional only after the plunger or other operative component is nearly fully displaced so that a full proper restoration movement is obtained following each on or off actuation.

Another object of the present invention is to eliminate a number of springs opposing the movement of the switch in an operating direction and to replace such opposition with a simple resistance effected by a spring and a base plate member so that less manual effort is required to effect either an on or off operation. By reason of the reduction of the number of components, the resulting simplification and construction of the particular components renders it easier to produce each component, to assemble them and later to service the switch.

An important additional feature of the present invention is that while the initial movement of the switch operation is positive and occurs with a desirable degree of abruptness, the restoration movement occurs over a considerable portion of the return stroke and is characterized by a gentleness of operation which tends to preserve the components against breakage by shock loading and shear forces.

An overall object of the present invention is to improvise a new and improved method for producing a switch by providing from sheet metal stock a partially formed combination contactor plate and terminal piece, integrally molding a housing while the combination contactor plate and terminal piece are still integrally joined with the sheet metal stock, blanking the entire assembly from the metal stock, then assembling the remainder of the components relative thereto.

Other objects and features of the present invention will become apparent from a consideration of the following description which proceeds with reference to the accompanying drawings wherein certain selected embodiments of the invention are illustrated by way of example.

DRAWINGS

DETAILED DESCRIPTION OF THE INVENTION

Figure 6:
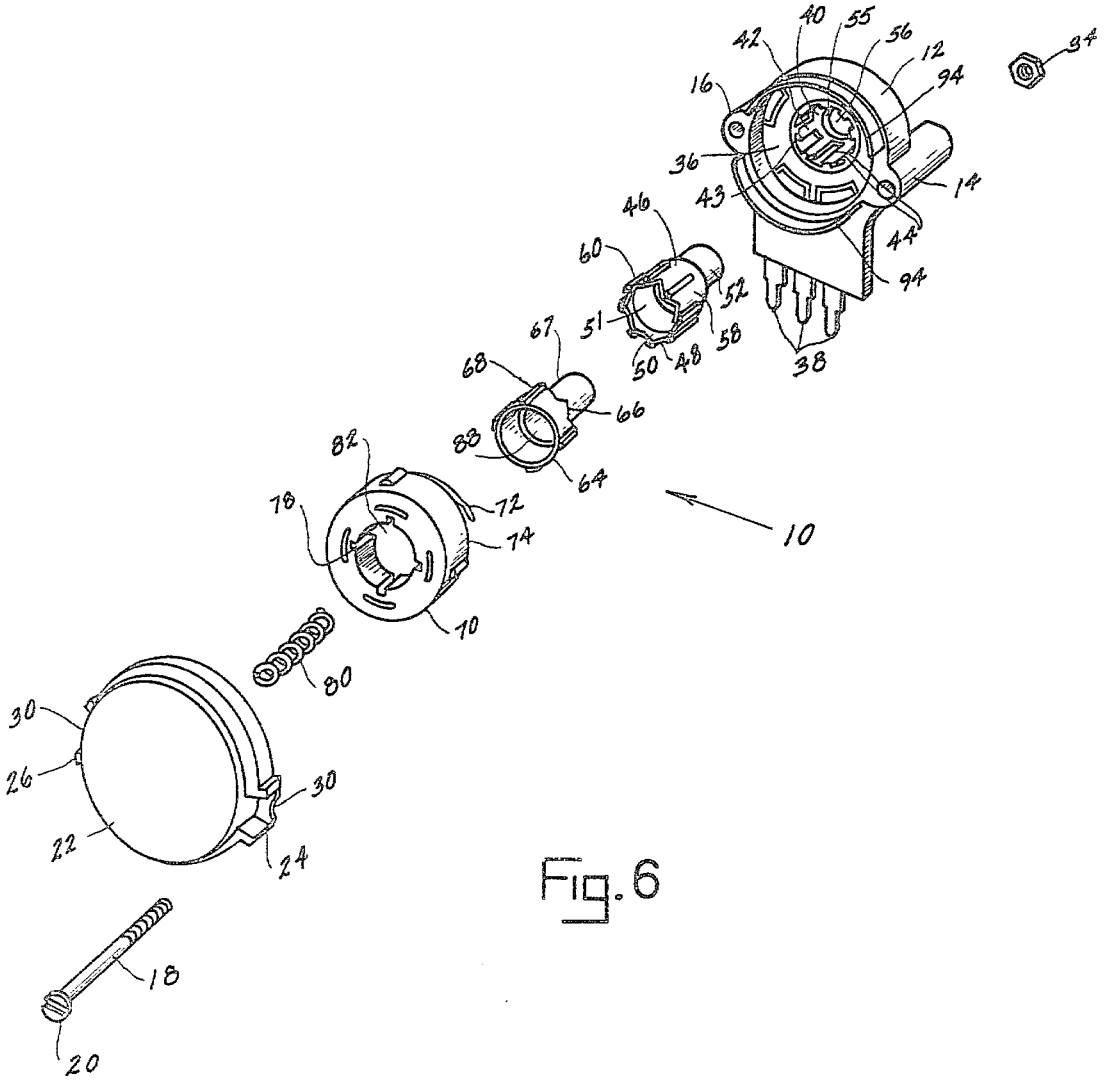
FIG. 6 is an isometric exploded view of the components of the push-push switch, the housing components being developed from the components previously described in FIGS. 1–5.

Referring now to the drawings and particularly to FIG. 6, a rotary switch construction designated generally by reference numeral 10 includes a circular housing 12 having two cylindrical embossments 14, 16 one on each side thereof and each adapted to receive a mounting bolt 18 having a head 20 and screw nut 34 by which the device can be mounted in relation to other radio controls including the volume control and tone control. Mounted on the housing 12 is a base plate 22 having arcuate tabs 24, 26 disposed approximately 180° apart, the tabs having openings 30 for each to receive a bolt 18 therein.

Internally of the housing 12 is a contactor plate 36. The co-construction of these two components is illustrated in FIGS. 1–5 and will be more fully described later in connection with the part of the description labeled "METHOD OF MANUFACTURE". Contactor plate 36 is rigidly held and permanently secured to the housing and has depending integrally attached terminals 38.

There is a central, axially extending opening 40 through the housing 12 and surrounding such opening, and radially projecting inwardly are a number of fixed abutments 42 at regular spaced intervals to provide bearing surfaces 44 one at each side of the abutments 42, the spacing being proportioned to form grooves. Each abutment 42 has an inclined surface 43 thereon.

Within the bore 40 is received a plunger 46 having crowned teeth 48 at spaced intervals about the end 50 thereof. A stem 52 is journalled in reduced diameter end 55 and extends through housing opening 56 as the push-button device which operates the push-push switch. About the outer periphery 58 are a number of spaced ribs 60 which fit within the grooves formed by the regularly spaced abutments 42 enabling the plunger to reciprocate longitudinally along the axis of the opening 40 but precluding rotation within the opening 40.

Coacting with the plunger 46 is a rotor 64 having crowned teeth 66 which match with the crowned teeth 48 about the end 50 of the plunger 46. Additionally, the rotor has a cylindrical stem 67 fitting within opening 51 for journalled movement relative to the reciprocable plunger 46. The rotor 64 has in addition to the crowned teeth 66 a number of external ribs 68 which serve to additionally rotate the rotor when such ribs 68 engage the inclined surfaces 43 on the spaced abutments 42 in a manner which will be explained more fully hereafter. Spacing of the ribs 68 is such that they fit within the grooves between adjacent abutments 42 in the opening 40 of the housing 12. There is keyed with rotor 64 a circular drive arm 70 with resilient contactor paddles 72, there being two sets of contactor paddles 72 at the undersurface 74. The drive connection between drive arm 70 and rotor 64 is effected through slots 78 drivably connected to the ribs 68 which serve as keys fitting within the slots 78 and thereby effecting their co-rotation.

A coil spring 80 passes through the central opening 82 of drive arm 70 and bottoms in the formed base (unnumbered) at the end of the blind opening 88 in the rotor 64, thus biasing the rotor 64 against the plunger 46. The spring 80 is held in its compressed position by means of the base plate 22 held in place through the tabs 24, 26 and bolts 18 in relation to the housing 12. Additionally, the edge 94 of the housing can be heat staked against 22 to provide additional securement, this being over and above the connection provided through the bolts 18 and nuts 34 which mechanically fasten the tabs 24, 26 to the housing 12.

OPERATION

Figure 8:
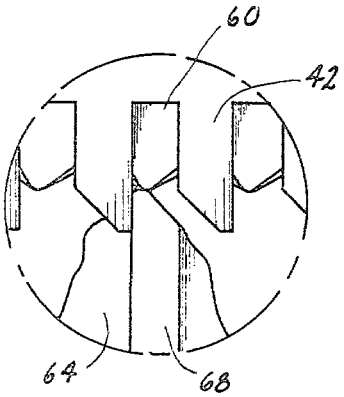
FIGS. 7–14 are cut-away interior views and detailed views illustrating the progressive movement of the crowned teeth and ribs as they progress through a switch operation and then restore for the next operation.
Figure 7:
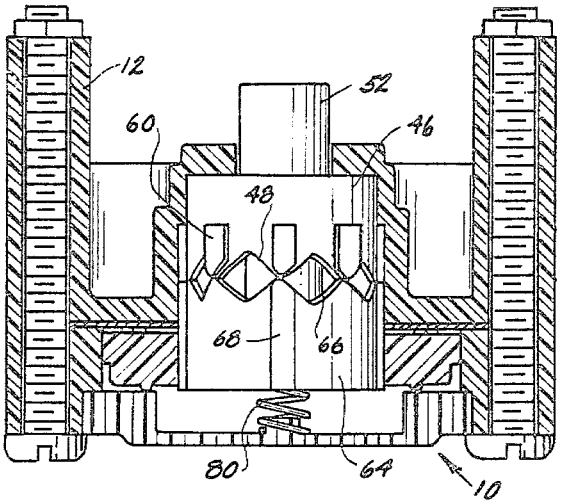
Figure 10:
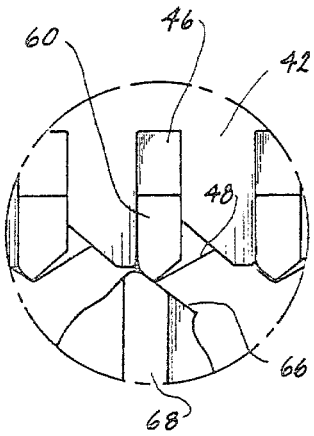
Figure 9:
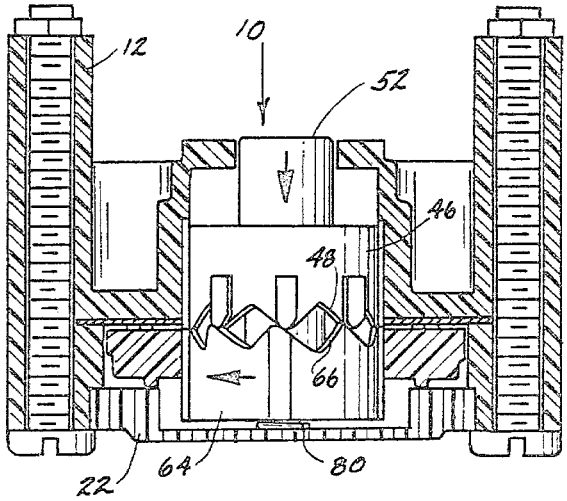
Figure 12:
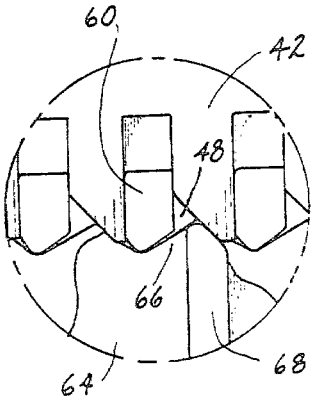
Figure 11:
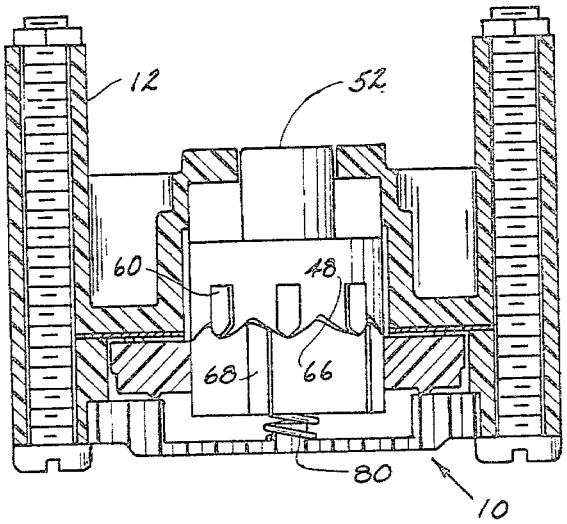
Figure 14:
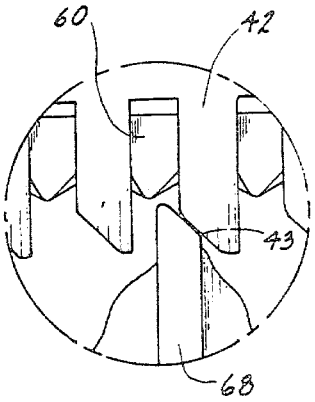

Referring now to FIGS. 7–14 and in particular FIGS. 7 and 8, the cut-away and detailed views show the switch in an initial or at rest position. Within the housing 12, the ribs 60 and 68 of the plunger and rotor, respectively, are aligned colinearly within respective grooves between the abutments 42. The teeth 66 of the rotor 64 engage the inclined faces of the teeth 48 of the plunger 46 such that when the stem 52 is depressed a sufficient distance to disengage the ribs 68 from the grooves between abutments 42, an angular movement of the rotor will be effected. Referring to FIGS. 9 and 10, the stem 52 is displaced inwardly against the resistance of the spring 80, forcing in unison the plunger 46 and rotor 64 toward the cover plate 22. In the process of so doing, the confronting crowned teeth 66 and 48 on the rotor and plunger, respectively, effect a torsional biasing effect on the rotor, since the confronting teeth engage each other along their inclined faces. Because of axial force between the rotor and the plunger together with the confronting inclined faces of the crowned teeth, a considerable biasing effect is developed but the rotor is prevented from turning until the external ribs 68 are displaced sufficiently to disengage the grooves between internal fixed abutments 42, and once this axial clearance is effected the crowned teeth 48, 66 will cause the rotor to move angularly as shown in FIGS. 9 and 10 by a fixed initial amount, the position of the rotor relative to the plunger now being advanced by approximately 22°. It should be understood that this advancement together with the next described advancement which is in the amount of approximately 23° is intended to equal a $\frac{1}{8}$ turn or 45°, with the next movement insuring a slight offset of the crowned teeth on the rotor relative to the crowned teeth of the plunger so that the teeth will never engage along their apices but instead engage along the inclined faces. At the completion of the initial movement as shown in FIGS. 11 and 12, the respective crowned teeth are fully internested. When the external force is relieved on stem 52 (FIGS. 13 and 14), the spring 80 is effective to restore the axial position of the rotor and plunger until shoulder 49 of the plunger 46 engages an interior base 13 of the housing 12, which circumposes the opening 56. In so axially displacing the two members together, respective inclined surfaces 43 on the abutments 42 act against the external ribs 68 to bias the rotor an additional angular increment, in this case 23°, so that the final relative position of the plunger and rotor is again the same as the initial position assumed at the start of the description of this operation (FIGS. 7 and 8). Thus, the initial and final positions of the rotor and plunger are always with the confronting teeth of the rotor and plunger slightly offset with their apices located such that the ribs of each are colinearly arranged within the grooves separating the abutments 42, and with the teeth of the rotor engaging the inclined faces of the crowned teeth of the plunger. Thus, the two components are in position so that when the stem 52 is again depressed, the rotor is again displaced 22° followed by an additional 23° of movement when the external force is relieved and the spring 80 restores the rotor and plunger to their original positions. This operation occurs sequentially so that upon each displacement of stem 52 by a manual externally applied force, there will be at 45° movement of the rotor 64 and an accompanying 45° movement of the drive arm 70 and contactor paddles 72 relative to the contactor plate 36, which will effect successive on and off operations through the conductive portions of the plate 36 and integrally attached terminals 38.

The characteristics of the operation are best understood by reference to the graph (FIG. 15) which illustrates the axial distance or linear displacement of the plunger by depressing stem 52 plotted against the angular displacement of rotor 64, and the subsequent axial restoration by the spring 80. It is one of the characteristics of operation that the switch will not operate until the terminal portion of the inward movement of stem 52 against the resistance of spring 80 has been obtained. That is, nearly the full longitudinal movement of stem 52 is required before the switch will operate and the switch operation then occurs with a sudden or quick disengagement and initial angular movement of the rotor 64. This is characteristic of a good "clean" switch operation meaning a suddenness of operation wherein total disengagement occurs within a very narrow time frame. It should be noted that the distance D indicating the amount of plunger movement or stroke occurs almost throughout its full length before portion A of the curve occurs which is the initial angular movement of the rotor 64 relative to the contactor plate 36. This initial angular movement will occur only after the external ribs 68 are positioned longitudinally so that the ribs disengage from the abutments 42 within the housing 12. The suddenness and sharp commencement of this initial angular movement of operatio is what gives the switch its desirable characteristic of "clean" switch operation. In contrast with this operation, most of the switches with which the prior art is concerned produce a "lazy" or gradual disengagement as a function of the displacement of the plunger and this results in impositive and indefinite switch operation.

Figure 13:
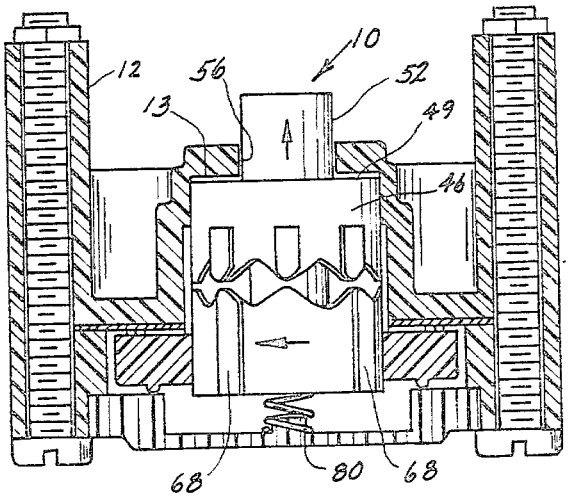
Figure 15:
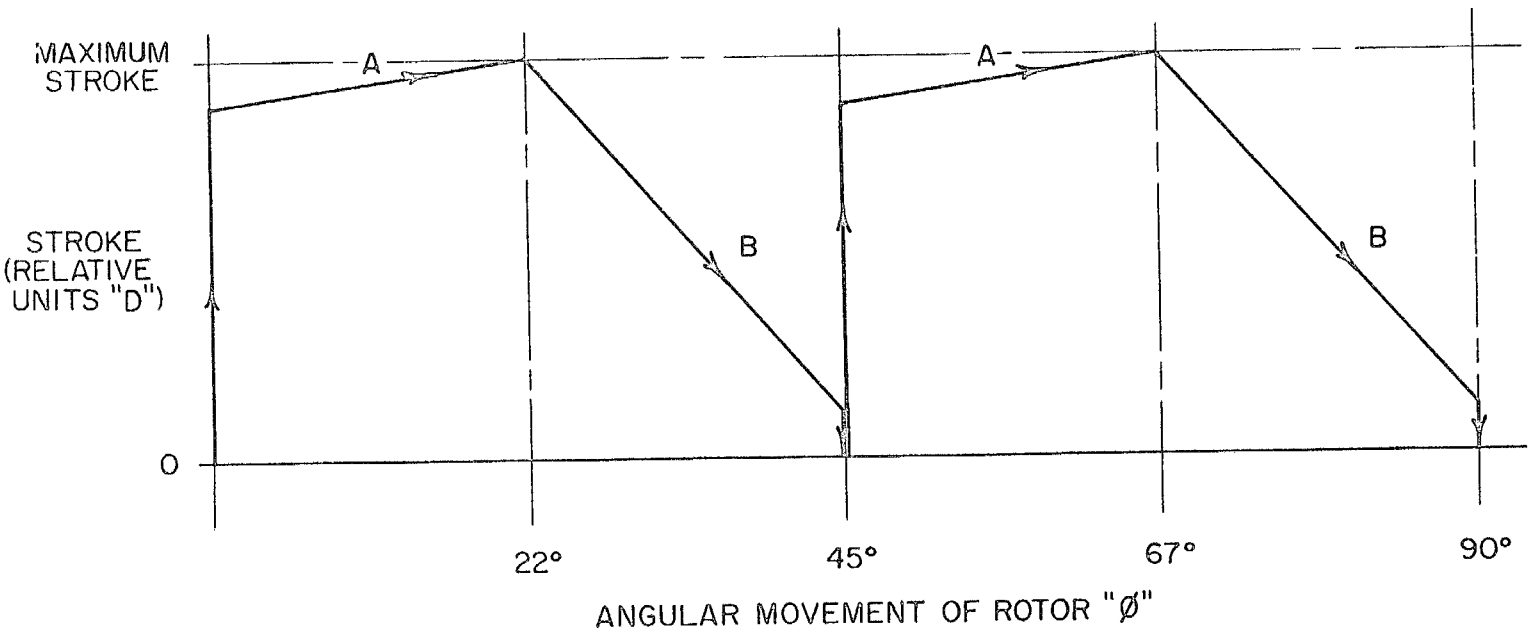
FIG. 15 is a graph illustrating the sequence of switch operation, plotting the axial movement of the plunger versus the angular displacement of the rotor, the components of the graph being understood to be repeatable but two complete phases of switch operation being graphically illustrated.

After the stem 52 has been fully depressed, and the switch is operated as pointed out by the initial stroke as shown in the graph, FIG. 15, external manual force on the stem 52 is relieved and the spring 80 will effect a restoring of the rotor 64 and plunger 46, displacing both upward as shown in FIG. 13 at which time the inclined surfaces 43 of the internal abutments 42 continue to effect a biasing action during resoration so that the characteristics of angular movement of the rotor are indicated by the next declining portion B of the curve in FIG. 15. It will be seen that the angular movement is gradual and continues throughout the rotor and plunger return stroke or restoration stroke effected by spring 80. Because the return speed is relatively slow, a low spring rate is permitted, the low spring rate also being advantageous because it does not offer excessive opposition to manual operation. The angular movement terminates very close to the end portion of the return stroke, as shown by portion B of the curve. At the next operation of the switch by depressing stem 52, the same characteristics of switch operation are obtained so that the switch is successively operated to on and off positions with the characteristic of sudden operation (known in the art as a "clean" operation) occurring over a very narrow band of stroke distance and time so that arcing is precluded and definiteness of the switch operation is obtained during each sequence. Likewise, the slow angular movement during the restoration stroke means that there are no externally imposed sudden forces of a torsional nature or impacting nature on the switch components so that they are not likely to fatigue or fracture in operation. Although very positive in operation, the switch is relatively easy to operate because all that is required is to overcome the resistance of the spring 80. Also, because the switch operation does not occur until the plunger is virtually fully depressed, there is available a full plunger actuation in a reverse direction to insure positive restoration following each switch operation.

METHOD OF MANUFACTURE

Figure 1:
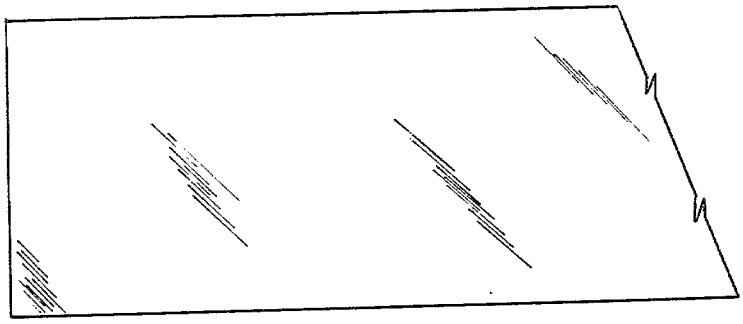
FIG. 1 illustrates sheet metal stock before any forming has occurred.
Figure 2:
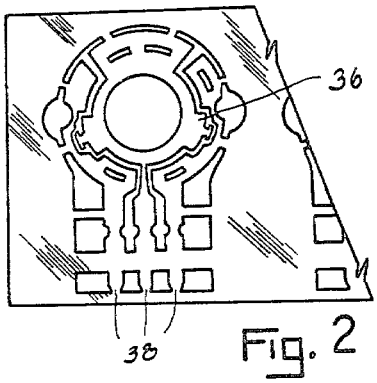
FIG. 2 is the next successive step in the operation in which there is incompletely formed terminals and a contactor plate still having tail stock connected thereto.
Figure 3:
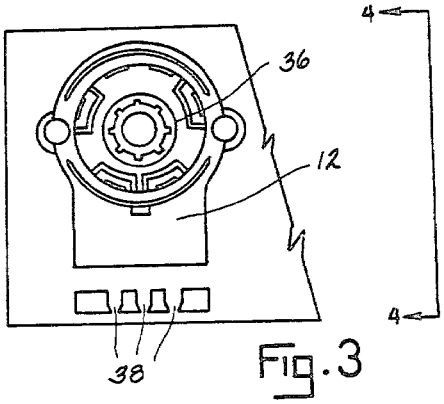
FIG. 3 illustrates the integral molding about the contactor plate and terminals using a heat curable resin to form the housing for the switch.
Figure 4:
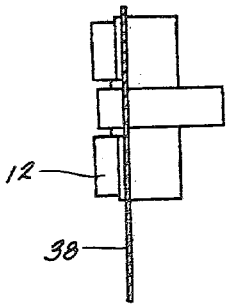
FIG. 4 is a view looking in the direction of the arrows 4—4 on the right-hand side of FIG. 3.

Referring to FIGS. 1–5, there is shown in FIG. 1 a sheet metal stock composition which is satisfactory for the manufacture of the contactor plate 36 and terminals 38. The plate and terminals are blanked out either by mechanical means or by chemical milling. The transition is from FIG. 1 or 2 in which the contactor plate and terminals have been incompletely but sufficiently formed, following which the housing 12 is molded over the outline of the plate and terminals in the manner indicated in FIGS. 3 and 4.

Figure 5:
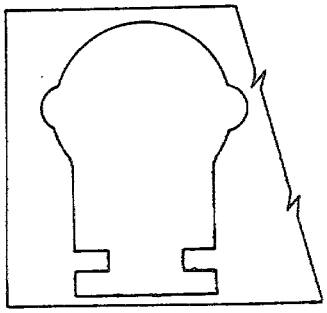
FIG. 5 illustrates the blanked out integrally formed contactor plate and molded housing.

After this molding step, the combination is then blanked from the sheet metal stock as shown in FIG. 5, the remainder of which serves as a carrier whereby the operation can occur continuously and the scrap portions of the sheet metal carrier stock are then returned for recovery of the metal.

The combination of the housing and the contactor plate and terminals is then fitted with the remainder of the switch components as shown in FIG. 6, the rotor 64 and plunger 46 being fitted together and then inserted into opening 40, the drive arm 70 keyed to the rotor 64 for circular operation therewith, the spring 80 inserted and the unit as a whole is then confined by means of a base plate 22 mechanically coupled with the housing through bolts 18, and the edge 94 can then be heat staked to the outer periphery of base plate 22 to hold the structure permanently in an assembled condition. This switch control can then be added to a combination volume control and tone control, the combined controls then attached to a radio which is then mounted in the dashboard of a vehicle in a conventional manner.

Although the present invention has been illustrated and described in connection with the single example embodiment it will be understood that this is illustrative of the invention and is by no means restrictive thereof. It is reasonably to be expected that those skilled in this art can make numerous revisions and adaptations of the invention and it is intended that such revisions and adaptations will be included within the scope of the following claims as equivalents of the invention.

What is claimed as new and desired to be secured by Letters Patent of the United States is:

1. A process for producing a control switch, comprising the steps of forming a contactor plate from sheet metal stock, insert molding a switch housing about said plate, trimming the housing-and-contactor plate subassembly from said sheet metal stock, mounting a first switch operating member within said housing and having a plurality of crowned gear teeth around the periphery of said first member, mating a second switch operating member having crowned gear teeth in confronting relation with the crowned teeth of said first member to effect rotary biasing movement therebetween, coupling for angular displacement with the second switch operating member a drive arm member having resilient contactor paddles, mounting a resilient spring member to resist longitudinal displacement of said first and second switch members, and capturing the combination of said members within an enclosed housing chamber such that the contactor paddles biasly engage the contactor plate whereby periodically effecting displacement of said first and second switch operating members in a switch operating direction against the resistance of the resilient spring member effects sequentially a joint longitudinal displacement of said first and second switch operating members and a coincident angular displacement of said second operating member, and releasing the switch effects a switch-restoring angular movement of said second operating member and a simultaneous joint longitudinal displacement of said first and second switch operating members.

2. A process for producing a control switch, comprising the steps of partially forming from sheet metal stock a contactor plate, molding a housing about said contactor plate which is integrally joined therewith, cutting the so assembled contactor plate and housing from the sheet metal stock mounting two opposed axially movable switch operating members internally of said housing and each member having confronting crowned gear teeth in interfacial engagement, spring loading said gear teeth into a neutral position, and enclosing the assembled combination to provide for external operation in opposition to said spring force.

3. The process in accordance with claim 2 including the step of coupling a plurality of switch arms to a rotary one of said first and second switch operating members whereby in response to the rotary movement of the one switch operating member the switch arms are displaced to effect successive circuit operations.

* * * * *